US005901392A

United States Patent [19]

Hsieh

[11] Patent Number: 5,901,392

[45] Date of Patent: May 11, 1999

[54] CONSTANT-PRESSURE WATERBED STRUCTURE

[75] Inventor: Hsuan-Chi Hsieh, Taipei, Taiwan

[73] Assignee: Lin-Mei Hsieh Yang, Taiwan

[21] Appl. No.: 09/086,179

[22] Filed: May 28, 1998

[51] Int. Cl.[6] ..... A47C 27/10

[52] U.S. Cl. ..... 5/681; 5/672

[58] Field of Search ..... 5/681, 678, 671, 5/672, 706

[56] References Cited

U.S. PATENT DOCUMENTS

| | | | |
|---|---|---|---|
| 4,100,635 | 7/1978 | Mitchell et al. | 5/672 |
| 4,169,295 | 10/1979 | Darling | 5/706 |
| 4,634,179 | 1/1987 | Hashimoto | 297/284.6 |
| 4,644,597 | 2/1987 | Walker | 5/706 |
| 4,663,790 | 5/1987 | Santo | 5/681 |
| 4,679,264 | 7/1987 | Mollura | 5/710 |
| 4,694,520 | 9/1987 | Paul et al. | 5/706 |
| 4,797,962 | 1/1989 | Goode | 5/713 |
| 5,020,176 | 6/1991 | Dotson | 5/713 |

*Primary Examiner*—Alex Grosz

*Attorney, Agent, or Firm*—Ware, Fressola, Van Der Sluys & Adolphson LLP

[57] ABSTRACT

A constant-pressure waterbed is provided, which can provide a constant air pressure to a sole air-pressure frame that surrounds a water-filled mattress so as to allow the water in the water-filled mattress to be always suitably compressed to provide the desired level of softness. The air-pressure frame is used to apply an air pressure of a preselected limit level to the water-filled mattress. The constant-pressure waterbed utilizes a drainage valve to drain excessive air in the event that the air pressure in the air-pressure frame is above a preselected limit level so as to maintain the air pressure at the preselected limit level. Moreover, the constant-pressure waterbed utilizes an air pump which can pump air into the air-pressure frame when the air pressure in the air-pressure frame is below the preselected limit level. The air pressure in the air-pressure frame can therefore always be maintained at the desired level so as to allow the water-filled mattress to always provide the desired level of softness.

5 Claims, 3 Drawing Sheets

CONSTANT-PRESSURE WATERBED STRUCTURE

BACKGROUND OF THE INVENTION

1. Field of the Invention

This invention relates to waterbed structures, and more particularly, to a constant-pressure waterbed that can provide a constant air pressure to the water-filled mattress so as to allow the water in the water-filled mattress to be always suitably pressurized to provide the desired level of softness.

2. Description of Related Art

A waterbed is a water-filled rubber or plastic mattress mounted in a surrounding air-pressure frame. Due to the highly deformable property of water, the water-filled mattress can provide a soft surface that conforms to the sleeper's body in any position, allowing a very comfortable and massaging effect for the sleeper resting thereon. The water-filled mattress can be adjusted in surface softness by varying the air pressure being applied thereto from the air-pressure frame. When the air-pressure frame is pressurized, it can compress the water-filled mattress to provide a harder surface; when the air-pressure frame is depressurized, it can cause the water-filled mattress to provide a softer surface.

From experiments and user responses, it has been learned that the most suitable air pressure from the air-pressure frame to cause the water-filled mattress to provide the most comfortable softness lies within the range from 0.1 $kg/cm^2$ to 0.3 $kg/cm^2$ (kilogram per square meter).

In use, however, the surface softness of the water-filled mattress can be undesirably affected in many ways due to changes in the total weight acting on the mattress. For instance, a weighty sleeper resting on the water-filled mattress will cause the mattress to be more pressurized than a light-weight sleeper. Therefore, if a first user is resting on a waterbed that has been previously adjusted in pressure for a second user, the first user may feel the mattress to be overly hard or soft to rest one if he/she is considerably more weighty or less weighty than the second user. Moreover, if two users are resting on such a waterbed, the increased total weight would undoubtedly make the waterbed much harder, and thus more uncomfortable to sleep on. In these circumstances, the waterbed needs to be readjusted in the air pressure in the air-pressure frame. If the waterbed is frequently used by different users, the repeated adjustments will be laborious and inconvenient.

There exists, therefore, a need for a waterbed whose air-pressure frame can always maintain the applied air pressure at a substantially fixed level, so as to allow the water-filled mattress to constantly provide the desired level of softness irrespective of any changes in the total weight acting on the water-filled mattress.

SUMMARY OF THE INVENTION

It is therefore an objective of the present invention to provide a constant-pressure waterbed whose air-pressure frame can always maintain the applied air pressure at a substantially fixed level, so as to allow the water-filled mattress to constantly provide the desired level of softness to the sleeper or sleepers irrespective of any changes in the total weight acting on the water-filled mattress.

It is another objective of the present invention to provide a constant-pressure waterbed which can allow the water-filled mattress to constantly provide the desired level of softness no matter how weighty the sleeper is or how many sleepers are resting thereon.

It is still another objective of the present invention to provide a constant-pressure waterbed which allows the user to easily and conveniently adjust the air pressure so as to allow the water-filled mattress to provide the most favorably desired level of softness.

In accordance with the foregoing and other objectives of the present invention, a constant-pressure waterbed is provided. The constant-pressure waterbed of the invention utilizes a drainage valve to drain excessive air in the event that the air pressure in the air-pressure frame is above a preselected limit level so as to maintain the air pressure at the preselected limit level. Moreover, the constant-pressure waterbed of the invention utilizes an air pump which can pump air into the air-pressure frame when the air pressure in the air-pressure frame is below the preselected limit level. The air pressure in the air-pressure frame can therefore always be maintained at the fixed level to allow the water-filled mattress to always provide the desired level of softness.

BRIEF DESCRIPTION OF DRAWINGS

The invention can be more fully understood by reading the following detailed description of the preferred embodiments, with reference made to the accompanying drawings, wherein.

DETAILED DESCRIPTION OF PREFERRED EMBODIMENTS

First Preferred Embodiment

Figure 1:
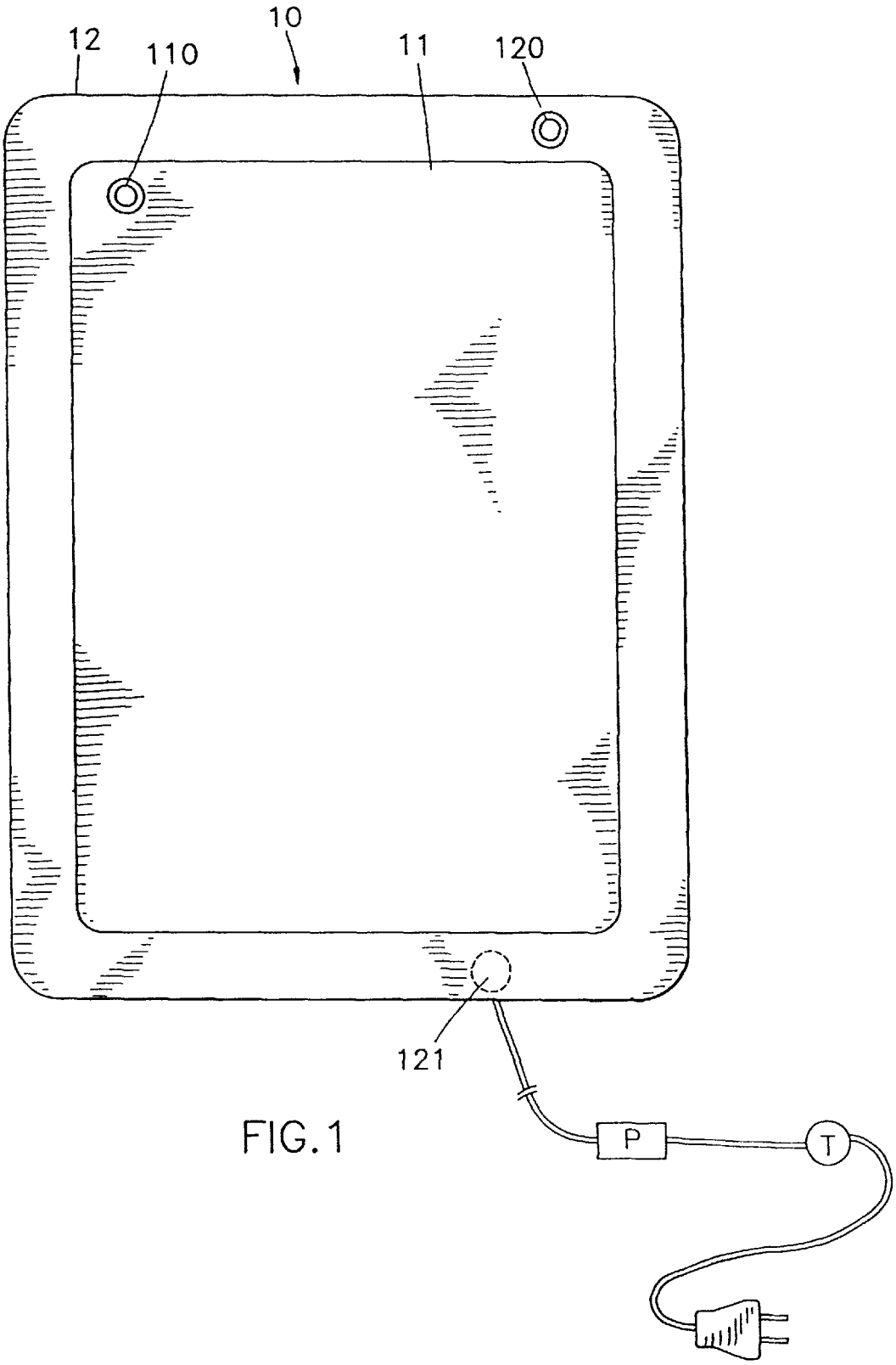
FIG. 1 is a schematic top view of a first preferred embodiment of the constant-pressure waterbed according to the invention.

FIG. 1 is a schematic top view of the first preferred embodiment of the constant-pressure waterbed according to the invention, as here indicated by the reference numeral 10. As shown, the waterbed 10 includes mainly a water-filled mattress 11 and an air-pressure frame 12 surrounding the water-filled mattress 11. Water can be filled into the water-filled mattress 11 through the inlet 110. Further, the waterbed 10 includes an air pump P connected to the inlet 121 on the air-pressure frame 12, and a timer controller T coupled to the air pump P for controlling the on/off operation of the air pump P. Moreover, the air-pressure frame 12 is formed with a drainage valve 120.

Figure 2A:
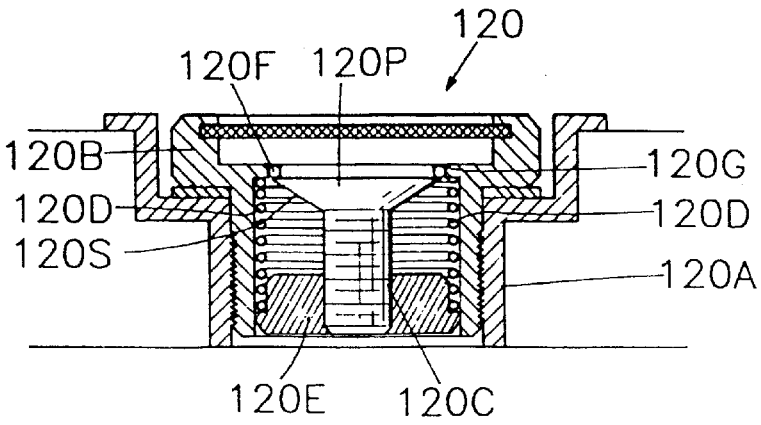
FIG. 2A is a schematic side view of a drainage valve utilized in the constant-pressure waterbed of the invention when the valve is closed.
Figure 2B:
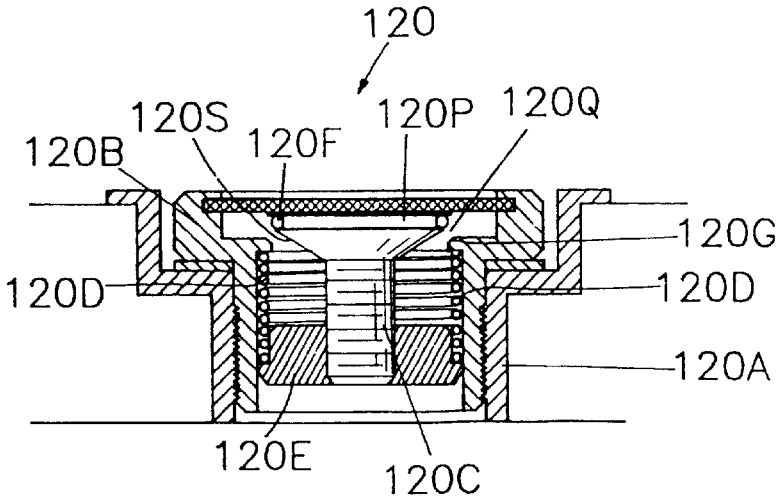
FIG. 2B shows the same of FIG. 2A except when the valve is opened.

FIGS. 2A–2B are schematic sectional diagrams used to depict the structure and operation of the drainage valve 120. As shown, the drainage valve 120 is composed of a mounting frame 120A, a casing 120B, a movable bolt 120C, a spring 120D, a locking nut 120E, an O-ring 120F, a valve mouth 120G, and a conical valve body 120P. The conical valve body 120P is formed with a tapered surface 120S at the top of the movable bolt 120C. The conical valve body 120P is coupled to the movable bolt 120C by means of the tapered surface 120S and an O-ring 120F in such a manner that allows the tapered surface 120S of the conical valve body 120P to be tightly abutted on the valve mouth 120G. The drainage valve 120 is designed to open when the air pressure in the air-pressure frame 12 is above a preselected limit level, and close when the air pressure is below the limit level. This feature can be provided by using a spring of a suitable elastic constant as the spring 120D.

When the air pressure in the air-pressure frame 12 is above a preselected limit level, it can overpower the elastic force of the spring 120D, thereby pushing the conical valve body 120P backwards to form an air escape gap 120Q as shown in FIG. 2B, allowing air to pass through the gap 120Q to the atmosphere. Further, as the air pressure in the air-pressure frame 12 is reduced to below the preselected limit level, the conical valve body 120P can be restored to original position due to the elastic force from the compressed spring 120D. Due to this mechanism, the air pressure in the air-pressure frame 12 can be always maintained at the preselected limit level even if the total weight of the sleeper or sleepers resting on the water-filled mattress 11 is changed.

The air-pressure frame 12 can be pressurized by using the air pump P. The air pump P can be controlled by the timer controller T to pump air into the air-pressure frame 12 periodically at a predetermine period for a predetermined duration. Typically, the air-pressure frame 12 can be inflated to the desired pressure of from 0.1 kg/cm$^2$ to 0.3 kg/cm$^2$ in 15 minutes. The timer controller T can thus be set in such a manner as to allow the air pump P to operate for a time period longer than 15 minutes, for example 20 minutes, each time the air pump P is turned on the timer controller T. Alternatively, the air pump P can operate in such a manner as to continuously pump air into the air-pressure frame 12 all the time during which the waterbed is in use. The excessive air pressure can escape through the drainage valve 120 to lower the air pressure, so that the air pressure in the air-pressure frame 12 can still constantly maintained at the preselected limit level. This allows the water-filled mattress 11 to always provide the desired level of softness to the sleeper or sleepers resting on the water-filled mattress 11, irrespective of any changes in the total weight of the sleeper or sleepers resting on the water-filled mattress 11.

For example, assume for a user of a weight of 130 pounds, the air-pressure frame 12 is set at 0.2 kg/cm$^2$ to allow the water-filled mattress 11 to provide the desired softness. When the user turns side, or another user of a weight of 150 pounds is resting on the water-filled mattress 11, it will cause the water-filled mattress 11 to be compressed, thus causing the air pressure in the air-pressure frame 12 to be increased. In this condition, the drainage valve 120 can be opened to allow air to escape to lower the air pressure. When the air pressure is reduced back to 0.2 kg/cm$^2$, the drainage valve 120 is closed. As a result, the water-filled mattress 11 can still suitably compressed by the air pressure from the air-pressure frame 12 to provide the desired level of softness to this heavier sleeper. After this, if another user of a weight less than 150 lb., for example 120 lb., is resting on the water-filled mattress 11, the insufficient air pressure from the air-pressure frame 12 can be pumped up by the air pump P, allowing the water-filled mattress 11 to still provide the desired level of softness to this light-weight sleeper.

Second Preferred Embodiment

Figure 3:
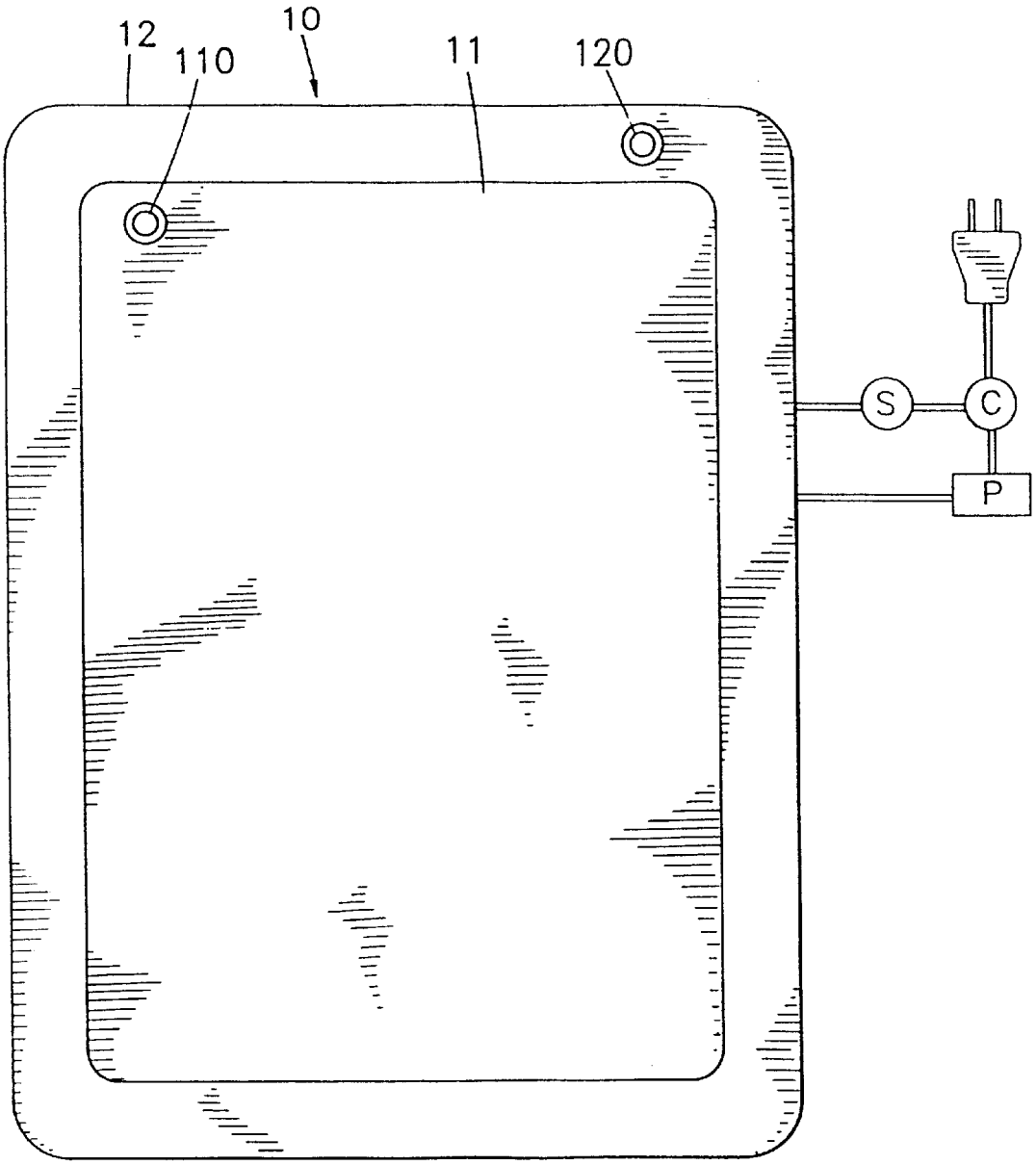
FIG. 3 is a schematic top view of a second preferred embodiment of the constant-pressure waterbed according to the invention.

FIG. 3 is a schematic top view of the second preferred embodiment of the constant-pressure waterbed according to the invention. The constant-pressure waterbed of this embodiment also includes a water-filled mattress 11 and an air-pressure frame 12 surrounding the water-filled mattress 11. It differs from the previous embodiment particularly in that the air pump P used to pressurize the air-pressure frame 12 is coupled to an air-pressure sensor S and a pump controller C.

The air-pressure sensor S is used to detect the air pressure in the air-pressure frame 12. If the air pressure in the air-pressure frame 12 is below a preselected limit level, for example 0.2 kg/cm$^2$, the air-pressure sensor S will generate a trigger signal to the controller C, causing the controller C to turn on the air pump P to pump air into the air-pressure frame 12. Until the air pressure in the air-pressure frame 12 reaches the preselected limit level, the air-pressure sensor S will disable the controller C so as to stop the air pump P. As the previous embodiment, if the air pressure in the drainage valve 120 is above the preselected level, it can be drained through the drainage valve 120. The air pressure in the air-pressure frame 12 can therefore always be maintained at the fixed level to allow the water-filled mattress 11 to always provide the desired level of softness.

As shown in FIGS. 1 and 3 the air-pressure frame is a sole, unitary structure that is integrally connected to the water-filled mattress.

The invention has been described using exemplary preferred embodiments. However, it is to be understood that the scope of the invention is not limited to the disclosed embodiments. On the contrary, it is intended to cover various modifications and similar arrangements. The scope of the claims, therefore, should be accorded the broadest interpretation so as to encompass all such modifications and similar arrangements.

What is claimed is:

1. A constant-pressure waterbed comprising:

a water-filled mattress;

a sole air-pressure frame surrounding and integrally connected to the water-filled mattress;

a drainage valve mounted on the air-pressure frame, the drainage valve being opened when the air pressure in the air-pressure frame exceeds a preselected limit level and closed when the air pressure in the air-pressure frame is below the preselected limit level; and an air pump for pumping air into the air-pressure frame when the air pressure in the air pressure frame is below the preselected limit level; wherein the drainage valve comprises:

a movable closing member which closes the valve when located at the closed position and opens the valve when dislocated from the closed position; and elastic means coupled to the movable closing member; the elastic means having a preselected elastic constant that allows the movable closing member to be located at the closed position when the air pressure in the air-pressure frame is below the preselected limit level, and dislocated from the closed position when the air pressure in the air-pressure frame exceeds the preselected level due to the air pressure being greater than the elastic resistance from the elastic means.

2. The constant-pressure waterbed of claim 1, further comprising:

a timer controller coupled to the air pump to control the air-pressure frame to pump air into the air-pressure frame periodically at a predetermined period for a predetermined period.

3. The constant-pressure waterbed of claim 1, wherein the preselected limit level is within the range from 0.1 kg/cm$^2$ to 0.3 kg/cm$^2$.

4. A constant-pressure waterbed comprising:

a water-filled mattress;

a sole air-pressure frame surrounding and integrally connected to the water-filled mattress;

a drainage valve mounted on the air-pressure frame, the drainage valve being opened when the air pressure in the air-pressure frame exceeds a preselected limit level and closed when the air pressure in the air-pressure frame is below the preselected limit level;

an air pump for pumping air into the air-pressure frame;

an air pressure sensor for detecting the air-pressure in the air pressure frame, the air-pressure sensor generating a trigger signal when the air pressure is below the preselected limit level; and a pump controller capable of enabling the air pump to pump air into the air-pressure frame when receiving the trigger signal from the air-pressure sensor; wherein the drainage valve comprises:

a movable closing member which closes the valve when located at the closed position and opens the valve when dislocated from the closed position; and elastic means coupled to the movable closing member, the elastic means having a preselected elastic constant that allows the movable closing member to be located at the closed position when the air pressure in the air-pressure frame is below the preselected limit level, and dislocated from the closed position when the air pressure in the air-pressure frame exceeds the preselected level due to the air pressure being greater than the elastic resistance from the elastic means.

5. The constant-pressure waterbed of claim 4, wherein the preselected limit level is within the range from 0.1 $kg/cm^2$ to 0.3 $kg/cm^2$.

* * * * *